US010352094B1

(12) United States Patent
Lopez-Isa

(10) Patent No.: US 10,352,094 B1
(45) Date of Patent: Jul. 16, 2019

(54) STORAGE SYSTEM WITHIN A DOOR

(71) Applicant: Jimi Lopez-Isa, Tampa, FL (US)

(72) Inventor: Jimi Lopez-Isa, Tampa, FL (US)

( * ) Notice: Subject to any disclaimer, the term of this patent is extended or adjusted under 35 U.S.C. 154(b) by 0 days.

(21) Appl. No.: 16/223,846

(22) Filed: Dec. 18, 2018

(51) Int. Cl.
*E06B 7/34* (2006.01)
*A47B 96/06* (2006.01)
*A47B 96/16* (2006.01)

(52) U.S. Cl.
CPC ..... *E06B 7/34* (2013.01); *A47B 96/06* (2013.01); *A47B 96/16* (2013.01)

(58) Field of Classification Search
CPC ..... E06B 7/32; E06B 7/34; E06B 3/74; E06B 2003/7061; E06B 2003/7071; A47B 96/06; A47B 96/16
USPC ..... 312/321.5; 49/70
See application file for complete search history.

(56) References Cited

U.S. PATENT DOCUMENTS 3,822,925 A * 7/1974 Osroff ..... E06B 7/34 312/242
4,361,368 A * 11/1982 Daniels ..... A47B 55/00 211/73
4,448,463 A * 5/1984 Amos ..... A47B 67/00 312/111
4,846,430 A 7/1989 Ke
D305,153 S 12/1989 Elderkin
5,066,079 A * 11/1991 Lawrence ..... E05G 1/00 109/54
5,163,745 A 11/1992 Zagata
5,469,903 A * 11/1995 Stanley ..... E06B 3/7001 144/345
5,730,544 A * 3/1998 Dils ..... F16B 12/04 403/13
6,238,030 B1 5/2001 Matselboba
6,652,049 B1 11/2003 Tyner
7,784,430 B1 * 8/2010 Thorne ..... E06B 7/32 119/484
8,944,531 B2 * 2/2015 Wyman ..... A47B 51/00 312/245
9,380,891 B2 7/2016 Wittenberg et al.
2006/0115620 A1 6/2006 Anderson
2008/0134584 A1 * 6/2008 McGhee ..... E06B 7/32 49/484.1
2012/0223626 A1 9/2012 Thomas
2012/0280605 A1 11/2012 Nettles et al.
2014/0096471 A1 * 4/2014 Burrows ..... E06B 3/984 52/656.4

FOREIGN PATENT DOCUMENTS

GB 602611 A * 5/1948 ..... E06B 7/34
WO WO-8809425 A1 * 12/1988 ..... E06B 3/74
WO WO-9413175 A1 * 6/1994 ..... E06B 7/34

OTHER PUBLICATIONS

Cabidor. http://cabidor.com/cabidor-classic-deluxe/. Accessed on Feb. 5, 2019.
Bed-Bath & Beyond. Door Solutions Over-the-Door Mirror and Cosmetic Organizer. 1 page. From Bed Bath & Beyond website.
Bed Bath & Beyond. Real Simple Over Door Multi-Pocket Organizer. 1 page. from Bed Bath & Beyond website.

* cited by examiner

*Primary Examiner* — Andrew M Roersma
(74) *Attorney, Agent, or Firm* — Michele L. Lawson; Smith & Hopen, P.A.

(57) ABSTRACT

A storage system positioned within a door is presented. The storage system is generally comprised of a storage unit attached within a door assembly by a mounting system.

13 Claims, 19 Drawing Sheets

STORAGE SYSTEM WITHIN A DOOR

FIELD OF THE INVENTION

This invention relates to a novel storage system. More particularly, it relates to a storage system contained within the structure of a door.

BACKGROUND OF THE INVENTION

The storage industry is a multi-billion-dollar industry. Many people lack sufficient storage space, particularly when living in a small apartment house. While several free-standing closets and storage options are known, many people do not have the extra room for a free-standing structure as they require significant wall and/or floor space.

Storage units that can be mounted on the surface of a wall or door are similarly known, however these options have the disadvantage of being limited in the amount of space they can contain as they protrude from the surface upon which they are mounted.

U.S. Pat. No. 3,822,925 to Osroff discloses a utility-door storage container which can be detached from door to serve as a stand-alone storage container. Storage can only occur along the back wall of Osroff which does not maximize storage space. Osroff also affixes his storage container to the door using screws which can damage the storage container itself.

U.S. Pat. No. 5,163,745 to Zagata discloses a door closet in which the closet box extends only rearwardly while the front remains coplanar with the door thus severely limiting the amount of storage space.

U.S. Pat. No. 6,652,049 to Tyner discloses a storage and display door capable of having an open or a closed configuration. The display door has a curved back which extends rearwardly from the front of the door which decreases the amount of storage space. Further, the placement of the display door is not customizable.

U.S. Pat. No. 6,238,030 to Matselboba discloses a hollow-door closet which can be used to store jewelry or other flat items in a relatively small amount of space. The device of Matselboba is limited as to the amount of space available.

U.S. Patent Application Publication No. 2012/0223626 to Thomas discloses a storage device mounted within a door frame to store jewelry. The device of Thomas allows for a small amount of storage space.

As illustrated above, the prior art has several disadvantages when it comes to providing customizable options for storage. These disadvantages include the amount of space available, no customization options for placement of storage unit; and mounting means damaging the storage unit. Accordingly, what is needed is a novel customizable storage system that can maximize the available space without requiring utilization of a significant amount of wall and/or floor space.

SUMMARY OF INVENTION

A novel storage system for placement within the hollowed-out body of a door is presented herein. In the broadest embodiment, the storage system is broadly comprised of a storage unit mounted within the center of a door.

In an embodiment, a storage system is presented comprising: a door assembly comprised of a door and a storage unit positioned orthogonally within the door. The door may have a hollow center which defines an inner perimeter and a mounting system for attaching a storage unit within the inner perimeter of the door with the mounting system being a channel positioned around the inner perimeter of the door. The storage unit may be comprised of a front side, a back side, a first sidewall, a second sidewall, a top side and a bottom side defining a space forming a cavity therein; at least one storage means contained within the cavity; and at least one door attached to the front side of the storage unit to provide access to the cavity of the storage unit with the at least one door having at least one handle.

The storage unit may be formed from hard plastic. Specifically, the storage unit may be formed from two thermoformed plastic components attached together along an outer flange positioned around an outer perimeter of the storage unit to form an outer shell of the storage unit. The outer flange of the storage unit may be positioned within the channel of the mounting system to attach the storage unit to the inner perimeter of the door.

The storage system may further comprise: a door casing wherein the door casing comprises a door frame; a front molding attached to a front side of the door frame; and a back molding attached to a back side of the door frame, wherein the door casing surrounds an outer perimeter of the door.

The storage means may be selected from the group consisting of at least one shelf, at least one hanging rod, at least one hook, at least one rack, at least one drawer or a combination thereof.

In another embodiment, a storage system is presented comprising: a door formed from a plurality of door frame members, each having a channel disposed longitudinally along one side, wherein each of the plurality of door frame members attaches to another door frame member such that the channels align to define an inner perimeter in the shape of a square or rectangle complementary in size and shape to the storage unit and a storage unit positioned orthogonally within the door comprised of a front side, a back side, a first sidewall, a second sidewall, a top side and a bottom side defining a space forming a cavity therein; a flange extending around the outer perimeter of the storage unit wherein the flange is inserted into the channels of the door frame members to mount the storage unit within the door; at least one storage means contained within the cavity; and at least one door having at least one handle on the front side of the storage unit to provide access to the cavity of the storage unit.

The storage unit may be formed from two thermoformed plastic components attached together at the flange to form an outer shell of the storage unit.

The storage means may be selected from the group consisting of at least one shelf, at least one hanging rod, at least one hook, at least one rack, at least one drawer or a combination thereof.

In a further embodiment, a storage system is presented comprising: a door assembly comprised of a door hingedly connected to a door frame and having a hollow center which defines an inner perimeter and a mounting system for attaching a storage unit within the inner perimeter of the door wherein the mounting system is a channel; and a storage unit formed from thermoformed plastic positioned orthogonally within the door having a front side, a back side, the first sidewall, the second sidewall, the top side and the bottom side defining a space forming a cavity therein and at least one storage means contained within the cavity. The front side of the storage unit may have at least one door with at least one handle to provide access to the cavity of the storage unit.

The door itself may be comprised of a plurality of door frame members connected together through a tab and slot system in which each of the plurality of door frame members attaches to another door frame member such that the channels align to define an inner perimeter in the shape of a square or rectangle complementary in size and shape to the storage unit. The channel of the mounting system may be disposed longitudinally along one side of each of the plurality of door frame members.

The storage unit may be formed from two thermoformed plastic components attached together by an outer flange positioned around an outer perimeter of the storage unit. This outer flange of the storage unit may be inserted into the channel of the plurality of door frame members to mount the storage unit within the door.

In a further embodiment, the novel storage system is generally comprised of a storage unit which can be mounted within the center of a door via a track system which utilizes a pair of connected opposing u-shaped flanges to grip the inner perimeter edge of the door as well as a connection bar on the exterior surface of the storage unit. Upon tightening of the attachment means, the opposing u-shaped flanges compress against the surface of the door and the connection bars on the storage unit to securely fasten the storage unit within the door without causing damage to either the door or the storage unit.

Storage unit itself is fully customizable with regard to exterior skins, interior layout of storage means, and positioning of storage unit within door depending on placement of connection bars on storage unit. For example, if connection bars are positioned towards the front of the storage unit, the storage unit is positioned within the door so that the majority of the storage unit extends in a rearward direction from the door. Alternatively, if the connection bars are placed towards the rear of the storage unit, the storage unit is positioned so that a majority of the storage unit extends in a forward direction from door. Connection bars can be placed at any point along the axis of the top side, bottom side, first sidewall and second sidewall of the storage unit thus allowing for positioning of the storage unit in any orthogonal position relative to the door.

In an embodiment, a storage system is presented comprising: a door assembly and a storage unit. The door assembly comprises: a door having a handle on the front and back sides and a hollow center which defines an inner perimeter and a mounting system, such as a track system, for attaching a storage unit within the inner perimeter of the door. The storage unit is positioned orthogonally within the door and comprises: a front side, a back side, a first sidewall, a second sidewall, a top side and a bottom side connected to define a space forming a cavity therein and at least one storage means contained within the cavity. The front side of the storage unit can be at least one door having at least one handle to provide access to the cavity of the storage unit. The storage unit may be positioned at various orthogonal orientations to allow varying amounts of the storage unit to extend outwardly from either front or back of door.

The track system can be comprised of at least two tracks each having opposing first and second u-shaped flanges and a third u-shaped flange positioned orthogonally to the first and second u-shaped flanges, wherein each flange contains a channel; attachment means for attaching the first u-shaped flange to the door and the second u-shaped flange to the storage unit; and at least two connection bars attached to the storage unit. In a preferred embodiment, four tracks are positioned around the inner perimeter of the door and four connection bars are positioned correspondingly around the outer perimeter of the storage unit.

The back wall of the channel of the third u-shaped flange may contain a plurality of apertures wherein the attachment means are inserted into the plurality of apertures in the back wall of the channel of the third u-shaped flange and tightening of the attachment means compresses the second u-shaped flange tightly around the connection bar to secure the storage unit to the inner perimeter of the door. Tightening of the attachment means may also compress the first u-shaped flange tightly around the door to secure the storage unit to the inner perimeter of the door. A molding may be inserted into the channel of the third u-shaped flange to cover the attachment means from view.

The storage system may be further comprised of a door casing comprising a door frame, a front molding attached to the front side of the door frame and a back molding attached to the back side of the door frame wherein the door casing surrounds an outer perimeter of the door.

Storage means may be selected from the group consisting of at least one shelf, at least one hanging rod, at least one hook, at least one rack and at least one drawer. In embodiments where the storage means are shelves, shelving supports can be inserted into the corresponding orifices in the interior surfaces of the first and the second sidewalls of the storage unit which are configured linearly along a longitudinal or horizontal axis, to support the shelves.

In some embodiments, the back side of the storage unit is a solid wall where in other embodiments, the back side can be at least one door to provide access to the cavity of the storage unit.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
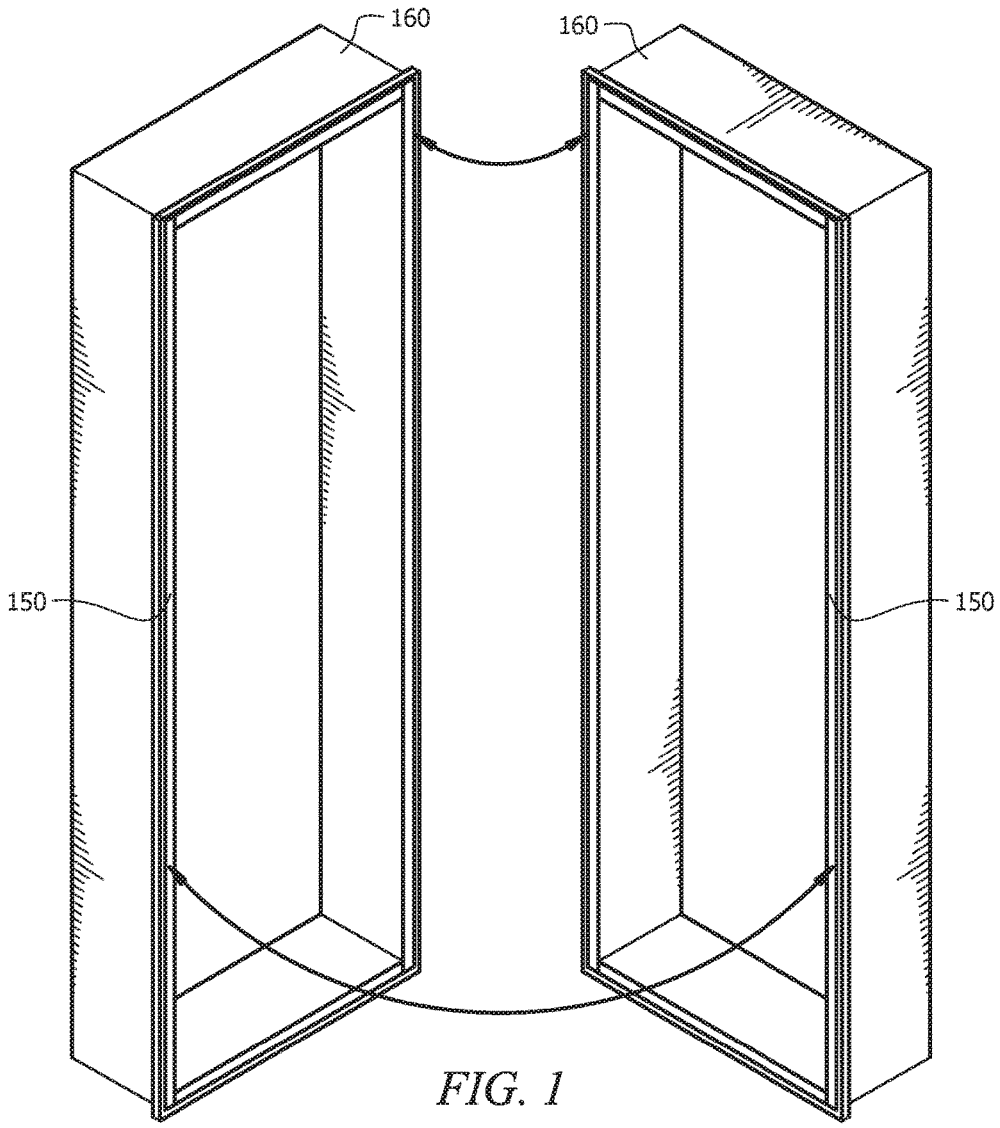
FIG. 1 is a perspective view of two halves of one embodiment of the storage unit.

In the following detailed description of the preferred embodiments, reference is made to the accompanying drawings, which form a part hereof, and within which are shown by way of illustration specific embodiments by which the invention may be practiced. It is to be understood that there are other embodiments by which the invention may be practiced. It is to be understood that other embodiments may be utilized, and structural changes may be made without departing from the scope of the invention.

Definitions

As used in the specification and claims, the singular form "a", "an" and "the" include plural references unless the context clearly dictates otherwise.

"Storage unit" as used herein refers to an enclosed space used for storing items. Storage unit can be formed from any hard, sturdy material including, but not limited to, plastics, wood, and metal. In some embodiments, the storage unit is formed from a thermoformed plastic which may be formed into one continuous outer shell or alternatively, may be in two separate components which can be joined together to form one continuous outer shell. If formed by two separate components, the pieces may be fixedly attached by any means known in the art and may have a flange positioned along the outer perimeter which would allow for positional attachment of the two pieces together to form one cohesive unit as well as provide a means for attachment of the storage unit to the inner perimeter of the door. In this embodiment, the flange would be capable of being inserted into a channel forming a mounting system within the perimeter of the door to attach the storage unit to the door. Edges of storage unit may be at a sharp right angle or alternatively may be rounded.

"Door assembly" as used herein refers to a door in combination with a mounting system for mounting the storage unit within the door.

"Door casing" as used herein refers to a system used to frame the outer perimeter of a door. In some embodiments, the door casing is only a door frame while in other embodiments, the door casing includes a door frame that is inserted within the opening in the wall for the door to frame the door once inserted as well as front and back moldings that are connected to the front and back of the door frame as well as the corresponding wall. Moldings are used to cover insertion of door frame into opening in the wall.

"Mounting system" as used herein refers to any system used that may be used to securely attach storage unit to inner perimeter of door. In one embodiment, mounting system may comprise one or more channels positioned within inner perimeter of the door for attachment of storage unit to door. In this embodiment, door itself may be formed from 4, 3, 2 or 1 individual frame components having a channel positioned in the inner perimeter thereof wherein the channels are of sufficient size and shape to house at least one flange positioned around perimeter of storage unit to attach storage unit to door. If formed from two or more individualized frame components, the frame components can be slid onto the flange of the storage unit so that the frame components surround the storage unit and are assembled to resemble a standard door.

In another embodiment, mounting system may comprise a track system as defined herein. In other embodiments, mounting system may include using attachment means such as screws, nails, glue, strong adhesive, slots, channels, tracks or any other means capable of attaching storage unit to inner perimeter of door.

"Frame components" or "frame members" or "door frame members" as used herein refers to 1 or more elongated individual components connected together and positioned around the perimeter of the storage unit to frame the storage unit and give the assembled storage system the appearance of a storage unit positioned orthogonally within a door. Door itself may be formed from 1, 2, 3 or 4 frame components. In the case of 2 or more individual frame components being used, each frame component may have a tab protruding from one end which fits into a corresponding slot on the adjacent frame component to attach the components together to form door surrounding storage unit. "Door frame members" represent individual components that when assembled form the hollowed-out door into which the storage unit is mounted. Conversely, "door frame" is used to represent the border outlining the threshold of a doorway with the door being positioned within, and attached to, the door frame.

"Track system" as used herein refers to a system for attaching the storage unit to the inner perimeter of the hollowed-out door using a series of tracks to align storage unit within inner perimeter and securely attach it to door. Track system is comprised of at least 2, preferably 4, tracks having at least 2, preferably 3, u-shaped flanges having a channel disposed therein with the first and second flanges being connected but being positioned in opposing orientation (and thus the channels being in opposing orientation) and the third flange being oriented orthogonally to the first and second flanges. In this embodiment, the inner perimeter of the door is inserted into the channel of the first flange and a connection bar attached to the exterior surface of the storage unit is inserted into the channel of the second flange. Attachment means can be inserted into the channel of the third flange which, when tightened, act to compress the sides of the first and second flanges to provide a tight connection between the first flange and the inner perimeter of the door and the second flange and the connection bar of the storage unit to securely connect the storage unit to the door. While an exemplary embodiment of the track system is described, other track system configurations are contemplated.

"Storage means" as used herein refers to an apparatus upon/within which objects can be stored including, but not limited to, shelves, drawers, hooks, racks, and hanging rods.

"Skins" as used herein refers to a decorative exterior surface of either the front or the back side of the storage unit. In some embodiments, the skins are permanently attached to the exterior surface while in other embodiments, the skins are inserted into a transparent cavity/pouch and can be interchangeable by the user.

"Hinge" as used herein refers to a joint that attaches two things together, in this case attaching door of storage unit to storage unit or attaching door containing storage unit to door frame, while allowing for limited movement of 180° or less, preferably 90°. Hinges used to attach door of storage unit to storage unit may differ from hinges used to attach door containing storage unit to door frame.

Storage system 10 is generally comprised of a customizable storage unit 160 mounted within door 170 via insertion of flange 150 into channel 140. Storage system 10 can be customized to fit different door sizes. Additionally, the interior of storage unit 160 can contain customizable shelving, hooks, hanging rods, racks such as shoe racks, etc.

As shown in FIG. 1, storage unit 160 may be formed from two separate halves which can be attached at flange 150 to form one cohesive unit having a cavity formed therein to contain customizable shelving, hooks, hanging rods, racks such as shoe racks, etc. In an embodiment, the two halves of storage unit 160 may be manufactured from thermoformed plastic with each half having a flange around the perimeter so that both halves can be attached at the flanges thus allowing storage unit 160 to have one continuous flange 150 positioned around center perimeter of storage unit 160. While FIG. 1 depicts the edges of storage unit being a straight edge, in some embodiments, edges may be slightly rounded (not shown). Each half of storage unit 160 may be identical, having the same depth, width and length. In alternative embodiments, storage unit 160 may be formed from one continuous outer shell as opposed to two halves.

Figure 2:
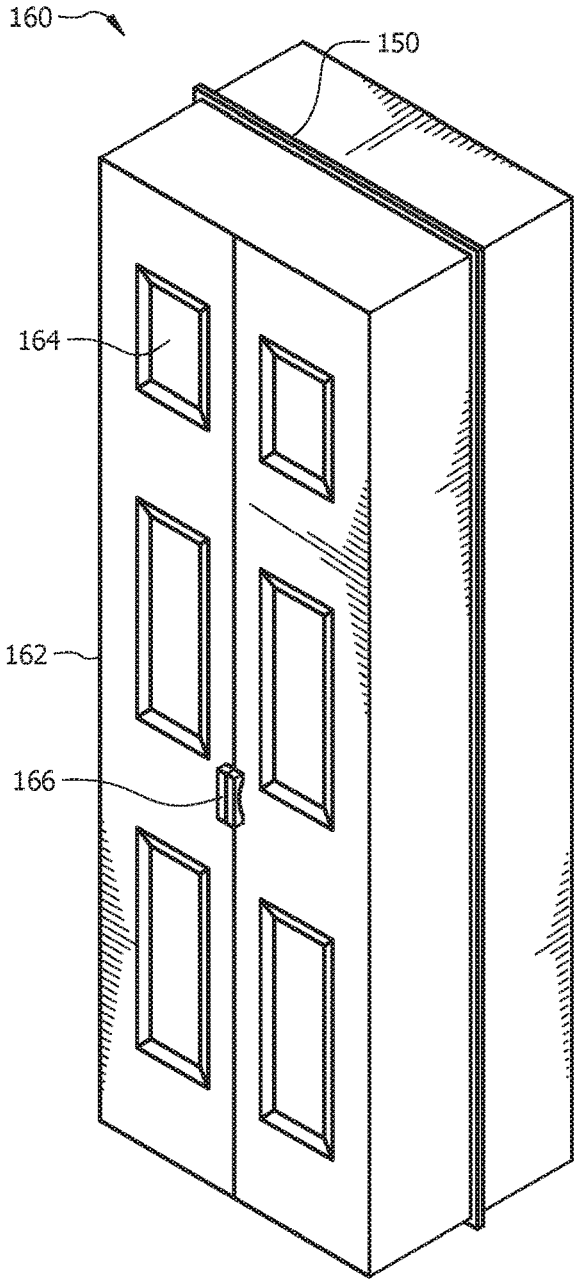
FIG. 2 is a perspective view of an assembled storage unit.
Figure 5:
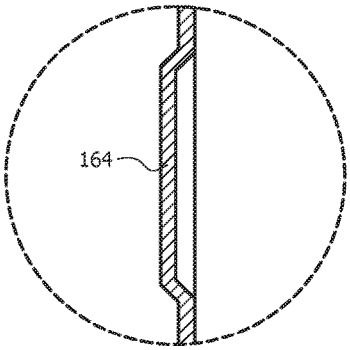
FIG. 5 is an exploded view of the decorative inlay on the storage unit door.

FIG. 2 depicts the two halves of storage unit 160 attached together at flange 150 to form storage unit 160. Door 162 of storage unit 160 may have a decorative inlay 164 as shown or may be smooth, depending on the preferences of the user. Opposing back side of storage unit may also have a corresponding decorative inlay 164 or be smooth. FIG. 5 depicts a cross section of decorative inlay 164.

Figure 3:
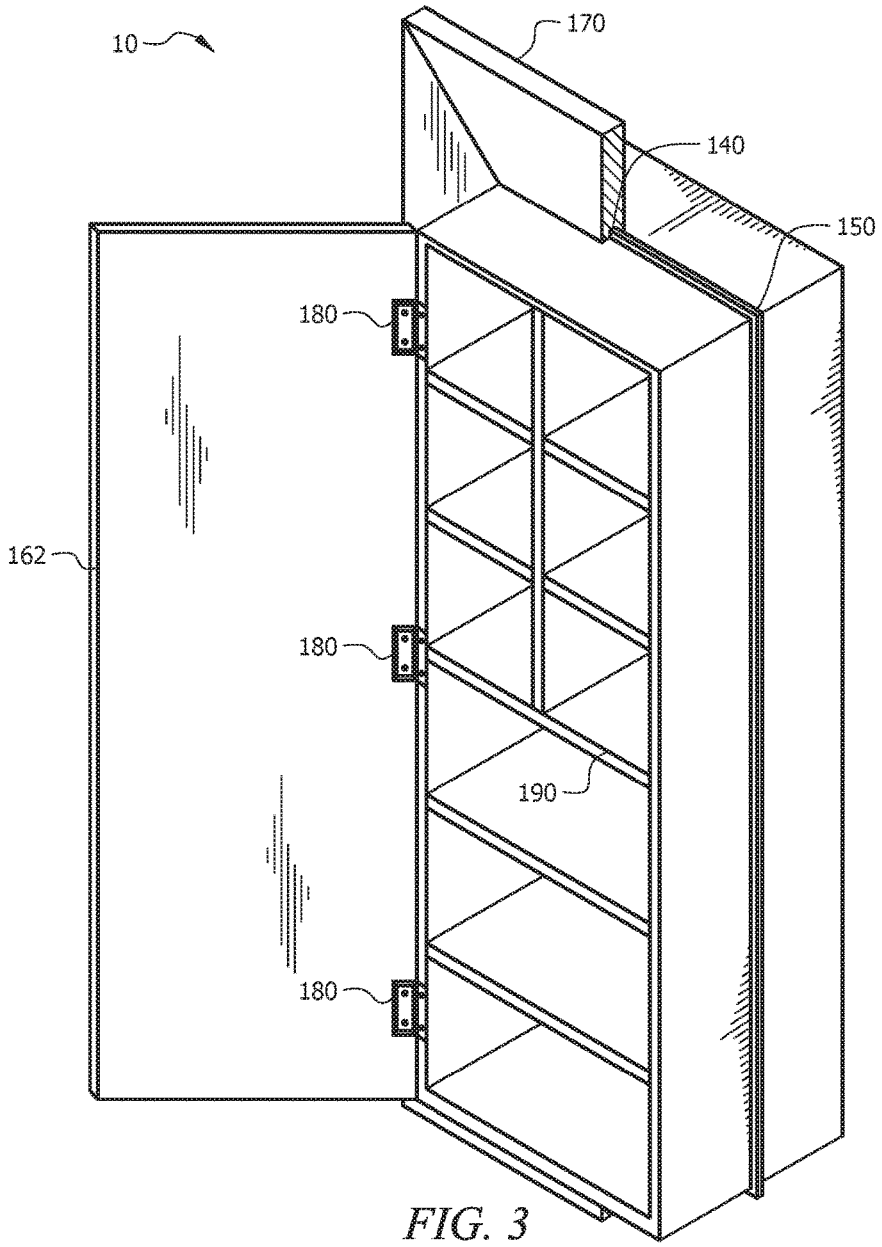
FIG. 3 is a perspective view of the interior cavity of the storage unit and a cutaway view of the door frame members attached to the storage unit.
Figure 4:
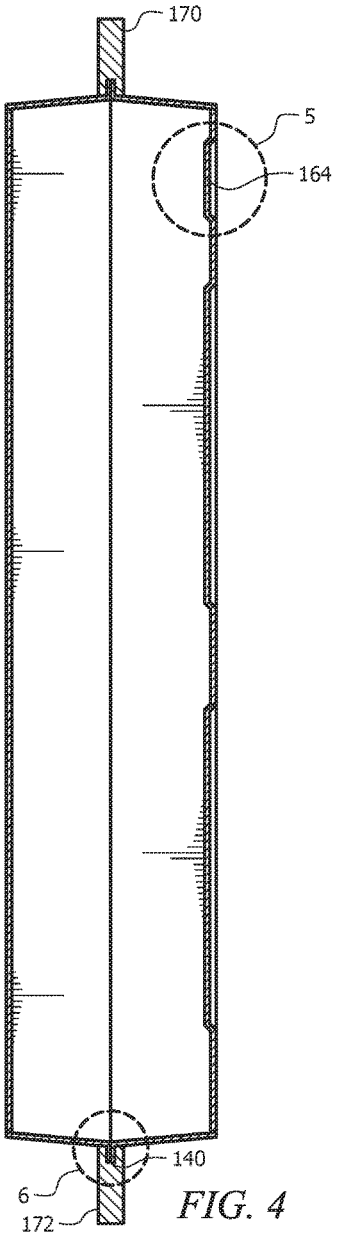
FIG. 4 is a cross sectional view of the storage unit attached to the door.
Figure 6:
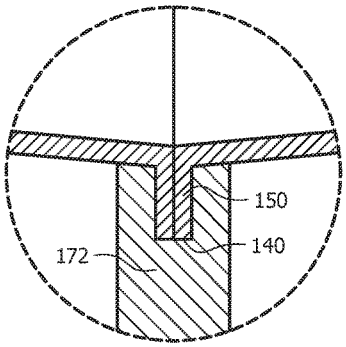
FIG. 6 is an exploded view of the attachment of the flange of the storage unit to the door via insertion of the flange into a channel in the door.

As shown in FIG. 3, storage unit 160 can be positioned within door 170 via insertion of flange 150 into channel 140. FIGS. 4 and 6 provide a cross sectional view of attachment of storage unit 160 to door 170. As depicted in the figures, flanges 150 of each half of storage unit are affixed together to form storage unit 160. This now singular flange 150 is inserted into channel 150 which extends around the inner perimeter of door 170. Channel 150 is sized to snugly fit singular flange 150 as shown in FIG. 6.

Door 170 of storage unit 160 may be attached via hinge 180 allowing limited movement of door of 180° or less, preferably 90°. Hinge 180 may be a European hinge or cup hinge which is positioned and totally concealed within the interior of storage unit 160, similar to that used to attach doors to kitchen or bathroom cabinets. In other embodiments, different hinges may be used including, but not limited to, butt hinges, surface mount inset hinges and knife hinges. While FIG. 3 depicts one door on storage unit 160, a pair of doors are also contemplated (as shown in FIG. 2) with the doors opening outwardly in opposing directions from each other to allow access to interior cavity of storage unit 160.

Shelves 190 may be fixed, adjustable or arranged in a combination of both fixed and adjustable. In some embodiments, shelves 190 may be attached to permanent dividers that are fixedly attached to the sides and back of storage unit 160 so that shelves 190 themselves may not be in direct contact with interior surface of storage unit 160.

Figure 7:
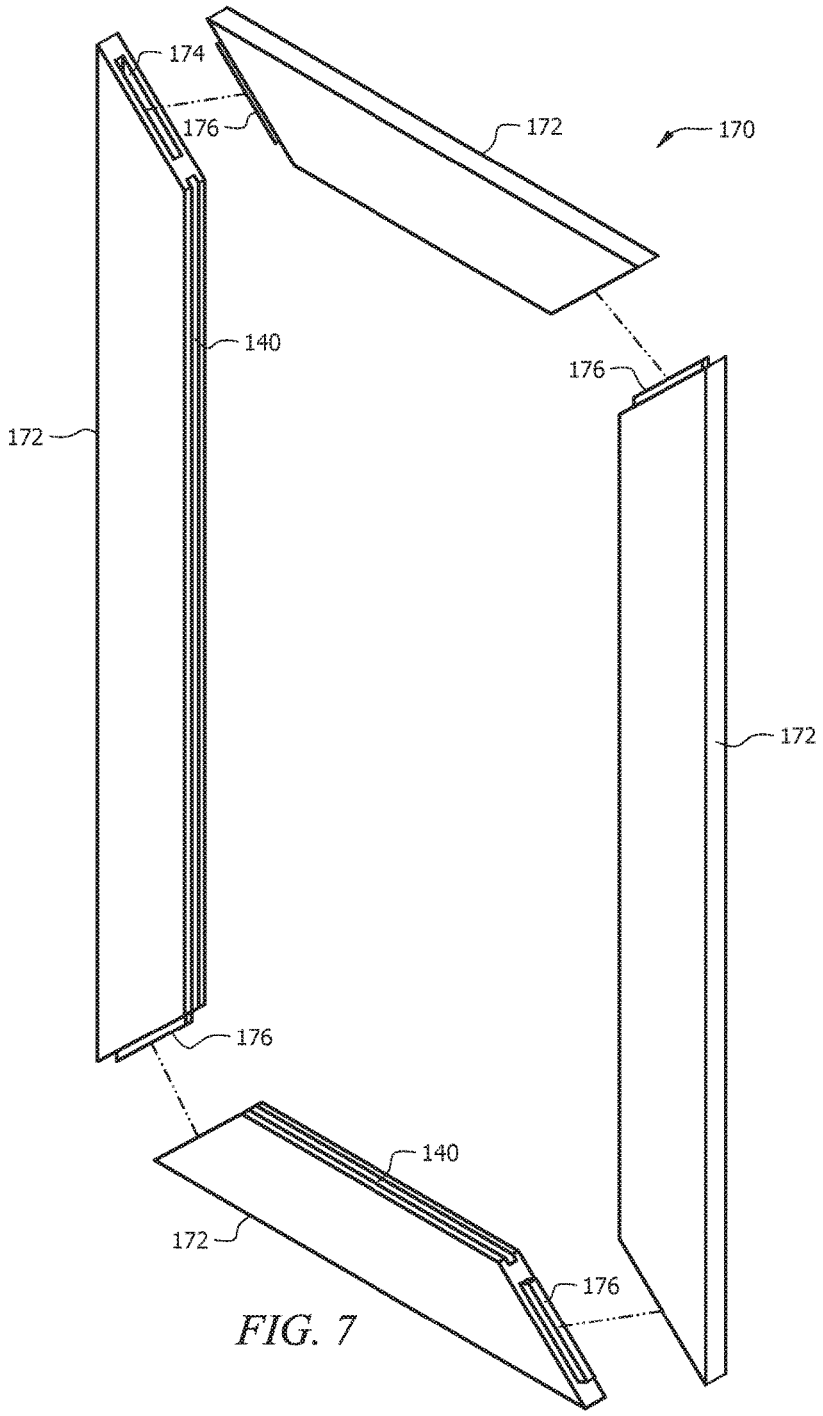
FIG. 7 is a perspective view of one embodiment in which a plurality of door frame members are attached together to form door.

FIG. 7 depicts one embodiment for assembly of door 170. Door frame members 172 may fit together through a notch or tab system in which one end of one frame member 172 has tab 176 which is capable of engaging in corresponding slot 174 on another frame member 172 to attach the two frame members 172 together. As depicted in the Figure, door 170 may be comprised of 4 individual frame members 172 which fit together. Each frame member 172 may have opposing ends with one end having tab 176 protruding therefrom and the other end housing slot 174 sized to receive tab 176 from another frame member 172. Slot 174 and tab 176 may be positioned in the center of the corresponding end of frame member 172 to allow tab 176 to be inserted into slot 174. Alternatively, slot 174 and tab 176 may be positioned against outer perimeter of frame member 172 to allow for tab 176 to slide into slot 174 from outer edge. In this embodiment, tab 176 is similarly sized to slot 174 both of which extend from outer perimeter towards middle of frame member 172 a sufficient length to allow outer perimeter edge of frame members to form a continuous corner of door 170 when attached.

Channel 140 is disposed within inner perimeter of each frame member 172. Channel 140 is of sufficient size so as to accommodate flange 150 of storage unit 160 and serves to mount storage unit 160 to door 170 formed from frame members 172. Channel 140 of each frame member 172 aligns to receive flange 150 and form door 170 around storage unit 160.

While 4 frame members 172 are depicted in FIG. 7, other embodiments may use 3, 2 or 1 frame member to form door 170. For example, in embodiments using 2 frame members, each frame member would have a horizontal member attached to a vertical member with aligned channels which could be slid over flange and attach to the other frame member to compose door and mount storage unit to interior perimeter of door. Frame members 172 may be manufactured of any material known to be used for doors including, but not limited to, wood and metal.

In manufacturing this embodiment of storage system 10, storage unit 160 can be comprised of two identical halves of thermoformed plastic resembling a box with one open side. Each half would have an identical sized flange positioned around the outer perimeter of the open side so that the open sides of each half can be attached together at their respective flanges to form the storage unit having an interior cavity therein. Any means known in the art can be used to attach the flanges of the two halves together including, but not limited to, glue and adhesive. Once assembled, one of the surfaces of one half which is directly opposite the opposing surface of the other half is removed and may be used as the door to the storage unit. This surface may be kept as one piece or divided into two if two doors are desired for the storage unit. In some instances, due to the thin nature of the removed surface, a laminated MDF backing may be added to the back surface to add stiffness and bulk. The door to the storage unit may be attached to the storage unit via hinges. The door frame members are then attached to the flange of the storage unit as well as to each other to form the door around the storage unit. This completed storage system may then be attached to a door frame.

In an alternative embodiment of storage system, storage system 15 is generally comprised of a customizable storage unit 70 mounted within door 30 via use of track system 40. Storage unit 70 can be customized to fit within different door sizes and existing doors can be retrofitted to accommodate storage unit 70. Additionally, the interior of storage unit 70 can contain customizable shelving, hooks, hanging rods, racks such as shoe racks, etc. The exterior of storage unit 70 can also be customized with various skins that, in some embodiments, can be interchangeable. In other embodiments, the exterior of storage unit may have an indented pattern of a decorative inlay allowing it to appear as a conventional door.

In some embodiments, storage unit 70 may extend forward from front 32 of door 30 and/or rearward from back 34 of door 30. The amount that storage unit 70 extends either forward or rearward depends on the placement of mounting system on storage unit 70. Storage unit 70 may extend forward at an amount that is greater than the amount extended rearward and vice versa. Alternatively, storage unit 70 may extend an equal amount forward and rearward. In some embodiments, front side 75 and/or back side 76 of storage unit may lie coplanar with exterior surface of door 30.

Figure 8:
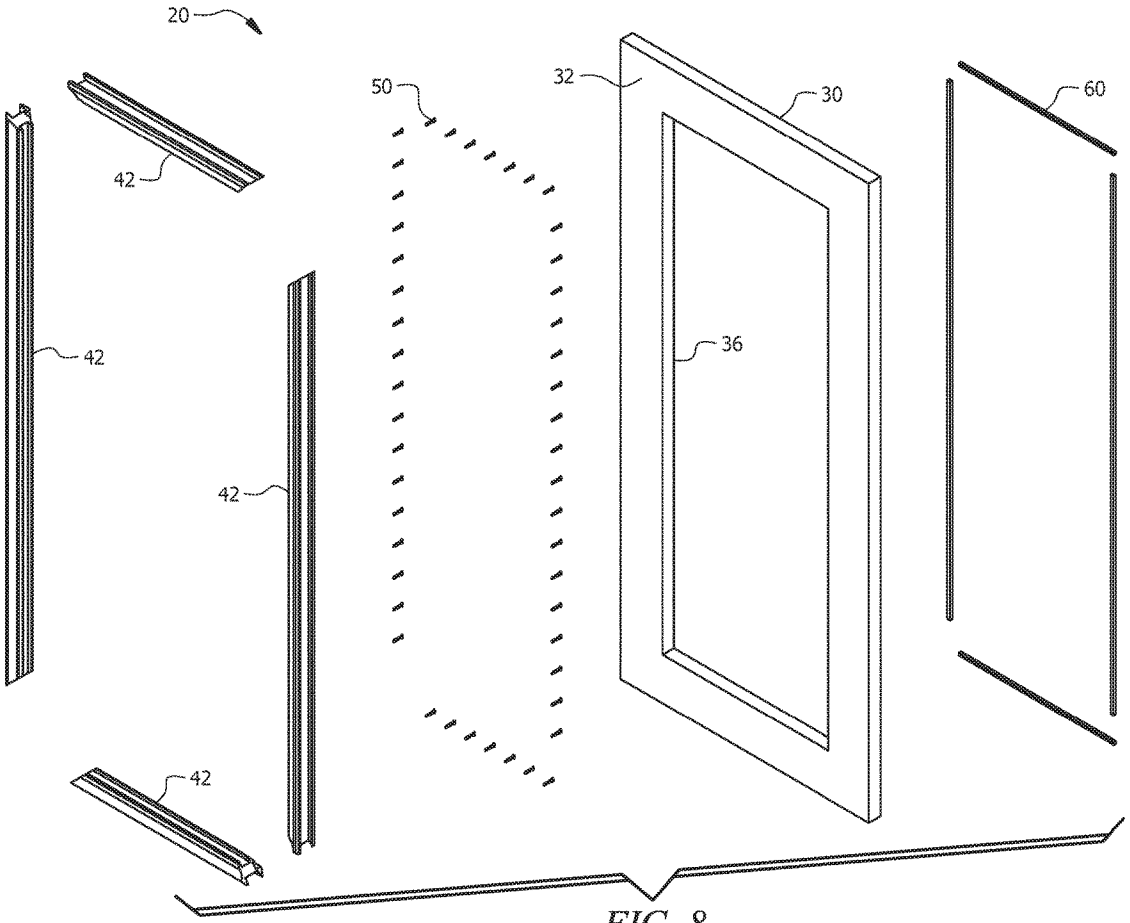
FIG. 8 is an exploded view of door assembly.
Figure 10:
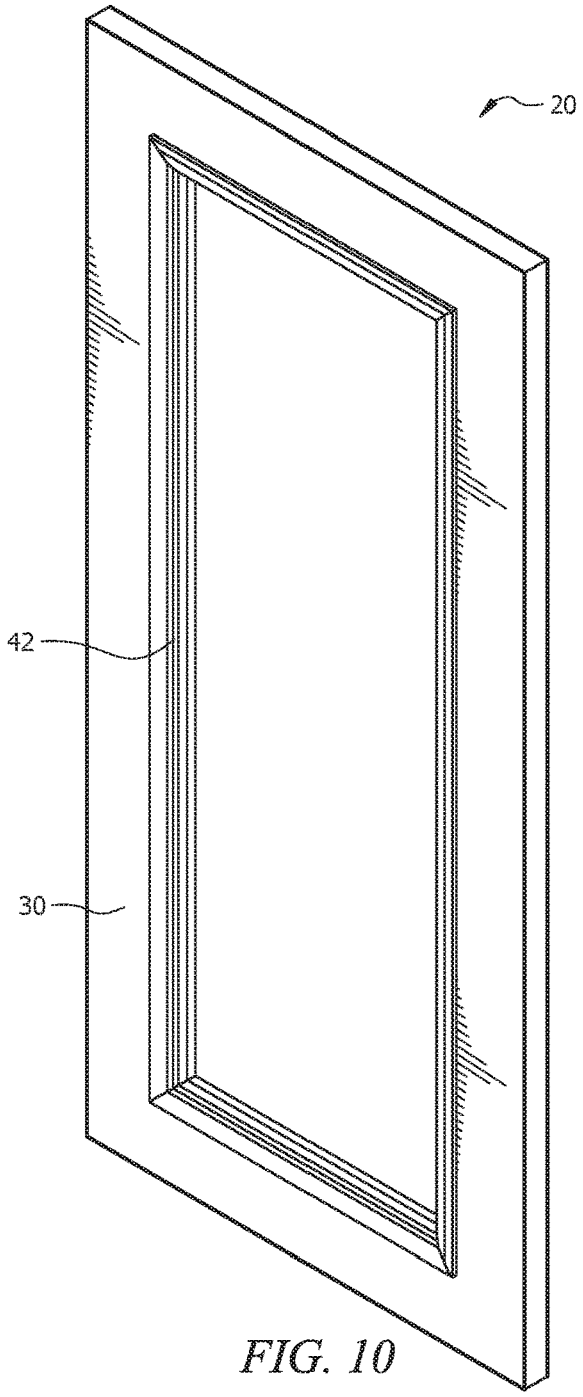
FIG. 10 is a perspective front view of door assembly.

FIG. 8 depicts door assembly 20 comprising door 30 and a mounting system for attaching storage unit 70 to door 30. Door 30 is comprised of a front side 32 and a back side 34 maintained in a parallel relationship with the outer edge boundary of door 30 defined by an outer perimeter. Within outer edge boundary, the center body of door 30 is hollowed out to define an inner perimeter 36 bounded by opposing longitudinal sides connected by a horizontal top and bottom. Storage unit 70 is housed within inner perimeter 36 of door 30. Mounting system may be track system 40 as described below. Door assembly 20 comprised of door 30 with track system 40 positioned in inner perimeter 36 is shown in FIG. 10.

Figure 9:
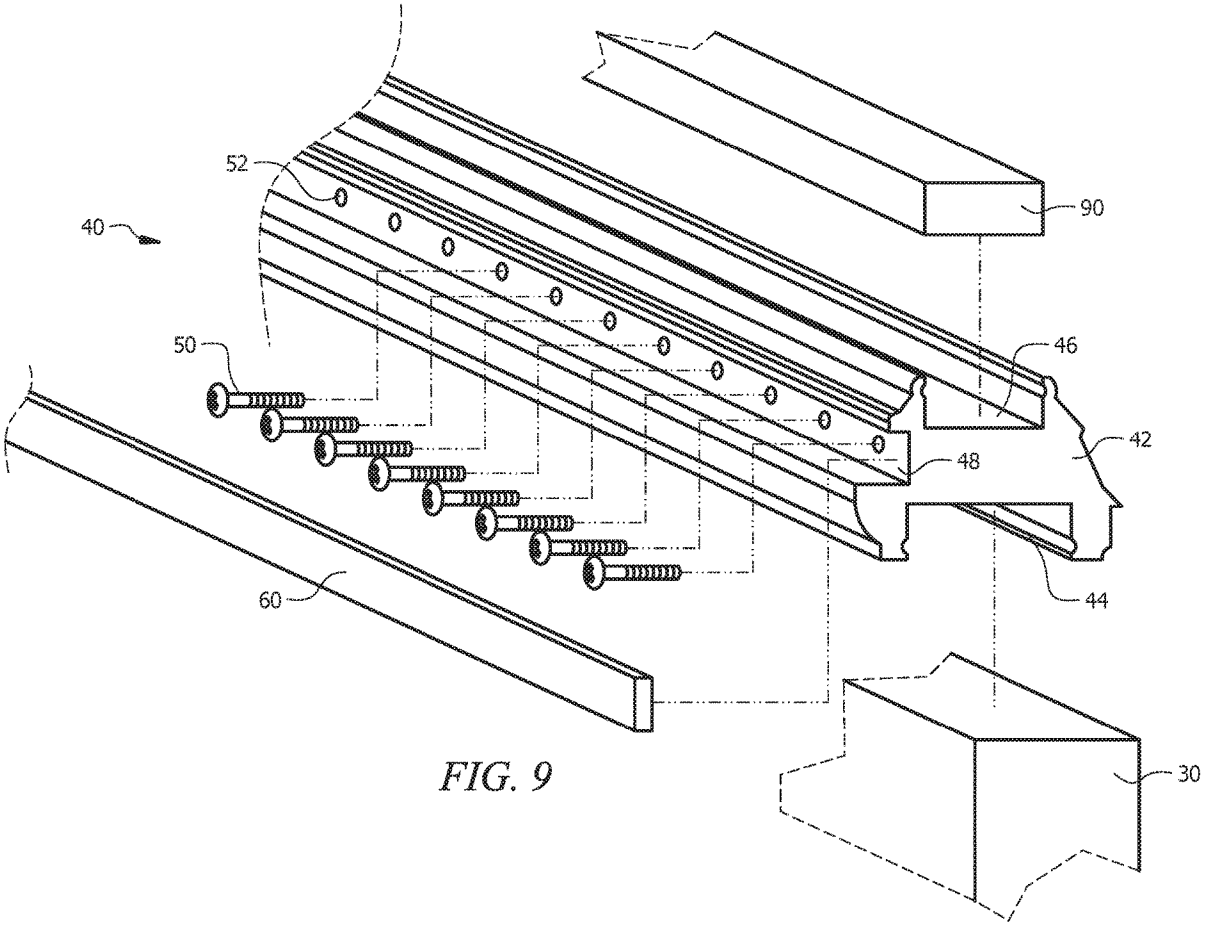
FIG. 9 is an exploded view of track system.

Track system 40 is comprised of four tracks positioned on inner perimeter 36 of door 30, with two longitudinal tracks 42 corresponding in size to opposing longitudinal sides of inner perimeter 36 of door 30, a top track 42 corresponding to horizontal top side of inner perimeter 36 of door 30, and a bottom track 42 corresponding to horizontal bottom side of inner perimeter 36 of door 30. As depicted in FIG. 9, track 42 is configured with first 44 and second 46 opposing u-shaped flanges commonly connected along the longitudinal axis of track 42. Each u-shaped flange forms a channel with the channel of first u-shaped flange 44 being of sufficient width to house the width of door 30, from exterior surface of front side 32 to exterior surface of back side 34, while channel of second u-shaped flange 46 is of a width sufficient to house connection bar 90 positioned around perimeter of storage unit 70. As such, channels of each of the first 44 and second 46 opposing u-shaped flanges may have differing widths depending on the width of connection bar 90 and door 30. Third u-shaped flange 48 is positioned orthogonally to first 44 and second 46 opposing u-shaped flanges with back of channel of third u-shaped flange 48 containing apertures 52 for attachment means 50. Attachment means 50 are positioned within apertures 52 of third u-shaped flange 48 such that, when tightened, act to compress the sides of first 44 and second 46 opposing u-shaped flanges. Compression of first 44 and second 46 opposing u-shaped flanges provides a tight attachment point for door 30 and connection bar 90 of storage unit 70 thus securely connecting storage unit 70 within inner perimeter 36 of door 30. In some embodiments, attachment means 50 is comprised of screws which may be tightened to provide sufficient compression of first 44 and second 46 opposing u-shaped flanges of track 42 to attach storage unit 70 to door 30. Molding 60 may be inserted into channel of third u-shaped flange 48 once attachment means 50 are in position to cover attachment means 50 from view.

In an alternative embodiment, channel of first u-shaped flange 44 is fixedly attached to inner perimeter 36 of door 30. In this embodiment, tightening of attachment means 50, after insertion of connection bar 90 into channel of second u-shaped flange 46, compresses only channel of second u-shaped flange 46 to securely attach storage unit 70 to door 30.

Figure 11:
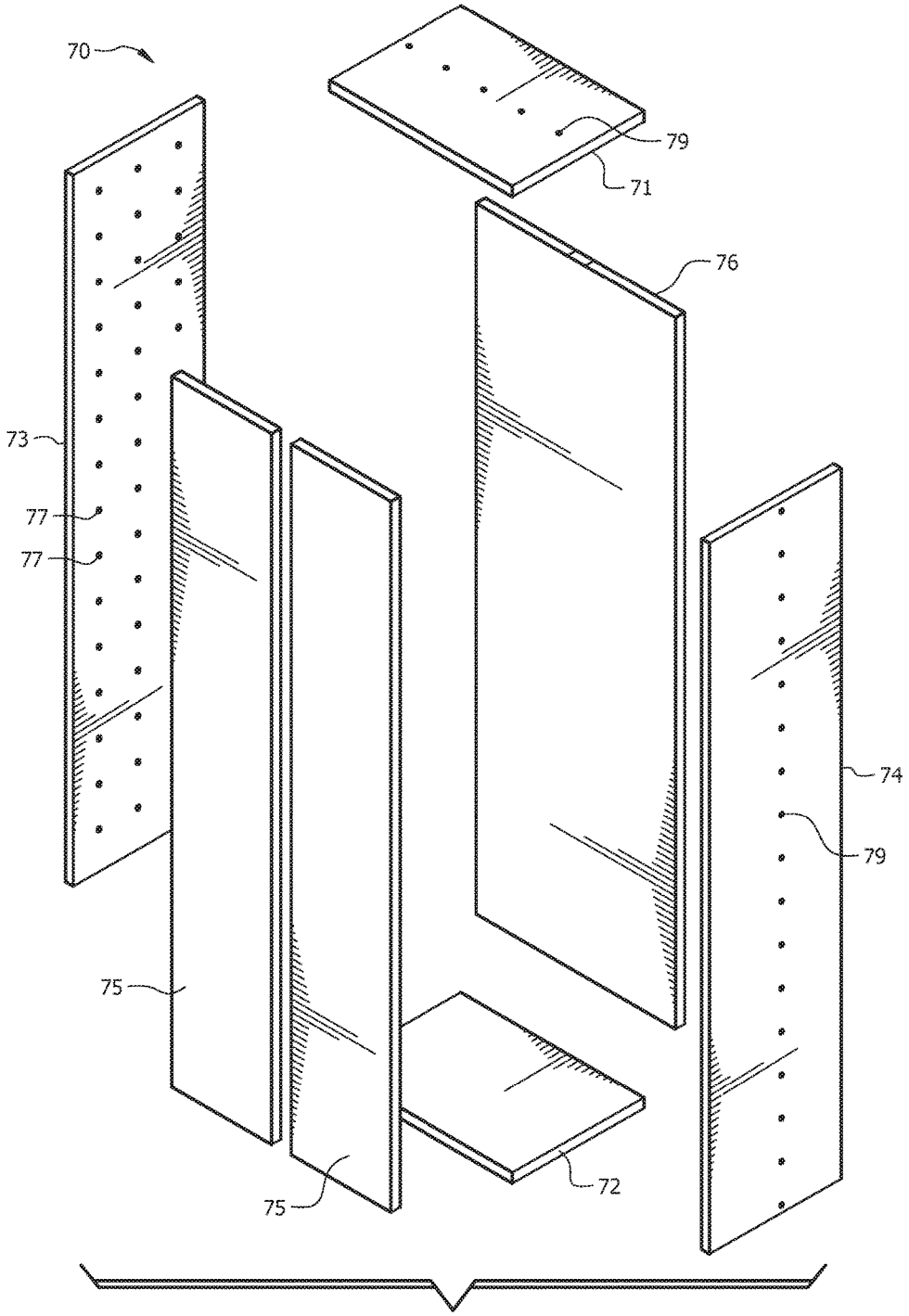
FIG. 11 is an exploded view of storage unit.
Figure 12:
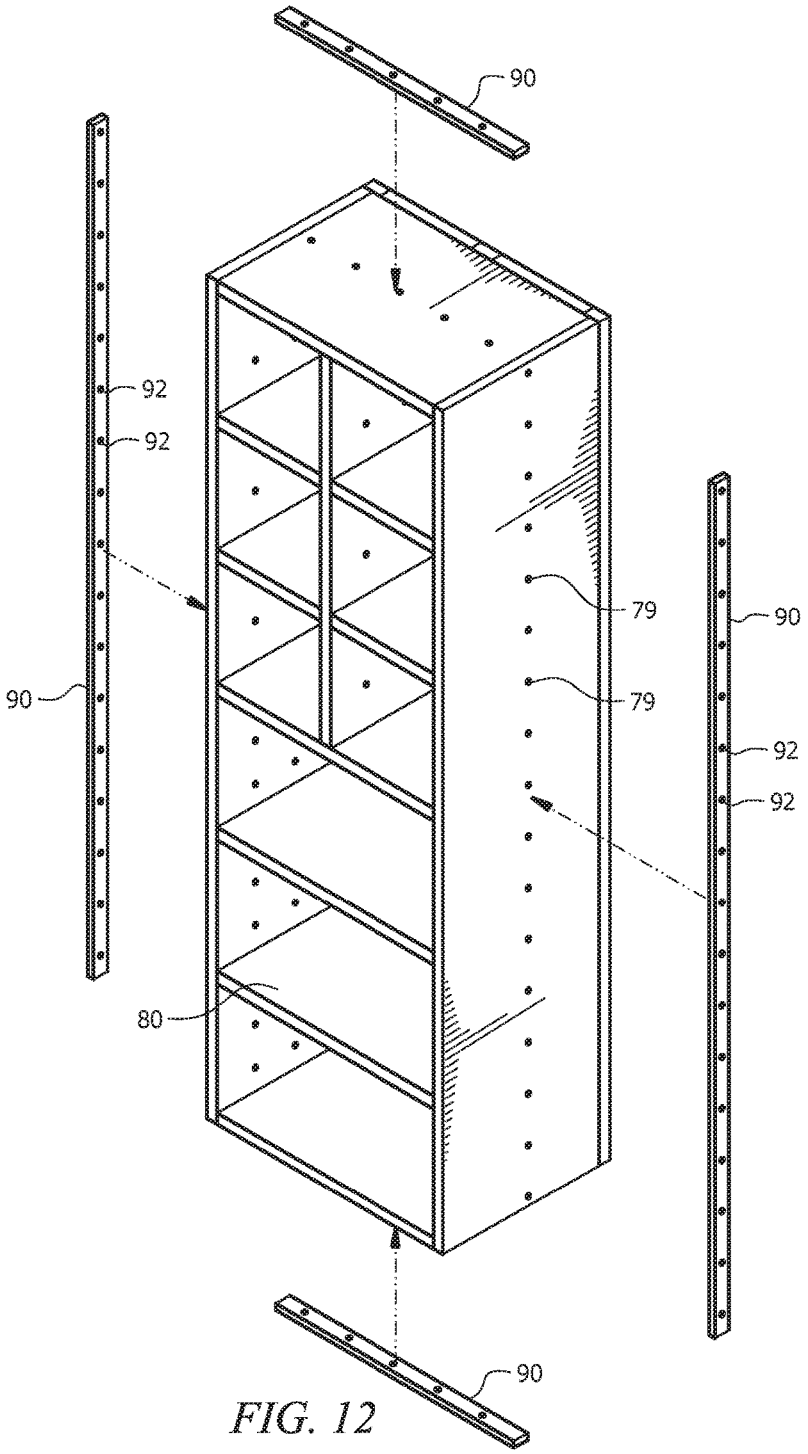
FIG. 12 is a perspective front view of storage unit showing connection bars.

FIG. 11 depicts the general structure of storage unit 70. As depicted in the figure, storage unit 70 is generally comprised of top side 71 spaced apart in parallel orientation from bottom side 72; first sidewall 73 spaced apart in parallel orientation from second sidewall 74; and front side 75 spaced apart in parallel orientation from opposing back side 76. The components of storage unit are fixedly attached together in the configuration shown in FIG. 11. As shown in the Figure, top side 71 is spaced apart from opposing bottom side 72; first sidewall 73 is spaced away from second sidewall 74; and front side 75 is spaced from back side 76 to define a cavity within storage unit 70. Cavity can be used to house shelves, racks, hooks, rods, racks, etc. which can be used for storage and organization of various articles. Each of top side 71, bottom side 72, first sidewall 73, second sidewall 74, front side 75 and back side 76 have interior and exterior surfaces. Interior surface refers to those surfaces forming the boundary of cavity. Exterior surface refers to those surfaces facing outwardly from cavity.

In an embodiment, exterior surfaces of top side 71, bottom side 72, and both first 73 and second 74 sidewalls may contain a plurality of apertures 79 arranged linearly along a longitudinal axis where the longitudinal axis corresponds to the orientation of inner perimeter 36 of door 30. Preferably, apertures 79 do not extend through to interior surface. Apertures 79 correspond with apertures 92 in connection bar 90 for attachment of connection bar 90 to storage unit 70 by attachment means 94. Attachment means 94 may include any means capable of fixedly attaching connection bars 90 to exterior surface of top side 71, bottom side 72, and both first 73 and second 74 sidewalls including, but not limited to, screws, nails, and adhesive means. If adhesive means are used, the plurality of apertures in the exterior surfaces of storage unit 70 and in connection bar 90 are not needed.

Connection bars 90 are designed to fit the entire length of top side 71, bottom side 72, first sidewall 73 and second sidewall 74 along the longitudinal axis. Connection bars 90 can be positioned at any point along exterior surface of top side 71, bottom side 72, first sidewall 73 and second sidewall 74 to allow for customization as to the amount storage unit 70 extends from either front 32 or back 34 of door 30.

Figure 13:
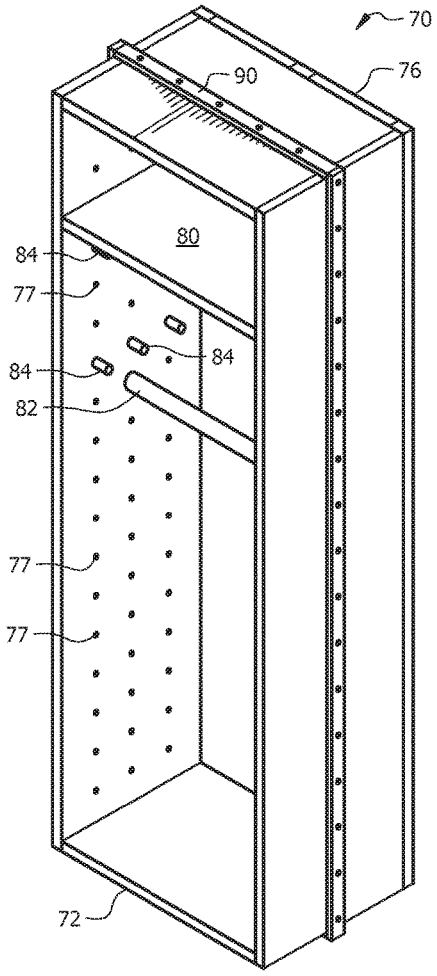
FIG. 13 is a perspective front view of interior cavity of storage unit with an exemplary configuration of storage means.
Figure 14:
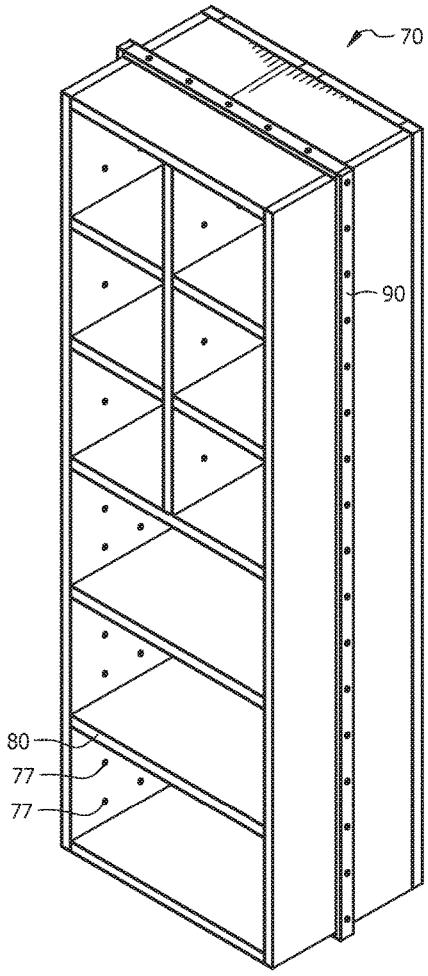
FIG. 14 is a perspective front view of interior cavity of storage unit with an exemplary configuration of storage means.

In an embodiment, interior surface of both first 73 and second 74 sidewalls may contain a plurality of orifices 77 which may be arranged linearly along a longitudinal or horizontal axis as depicted in FIG. 13. Arrangement of the plurality of orifices 77 in this manner allows for a plurality of different shelving configurations within storage unit 70. The location of each of the plurality of orifices 77 along first sidewall 73 correspond to the location of a corresponding orifice 77 on second sidewall 74 to allow for shelf 80 to be positioned on shelving supports 84 inserted into the plurality of orifices 77. Plurality of orifices 77 do not extend through to exterior surface of first 73 and second 74 sidewalls. Shelving supports 84 may take any form capable of supporting the weight of shelf 80 including, but not limited to, fixed shelving supports such as dowel rods and brackets as well as sliding shelving hardware such as ball bearing slides and full extension slides. Shelves 80 may take any configuration and size as long as shelf dimension is capable of fitting within interior cavity of storage unit 70. An exemplary shelving configuration is shown in FIGS. 13 and 14. Alternatively to shelves, storage means may include hanging rods, hooks, drawers, racks, etc.

In an alternative embodiment, interior surface of cavity of storage unit 70 is smooth with permanent dividers affixed in a vertical orientation to the interior of cavity. The dividers can be affixed via any means known in the art including, but not limited to, adhesive, glue, and epoxy. Shelves 80 can then be inserted between the permanent dividers so that shelves 80 are not in contact with interior surface of the cavity of storage unit.

Figure 15:
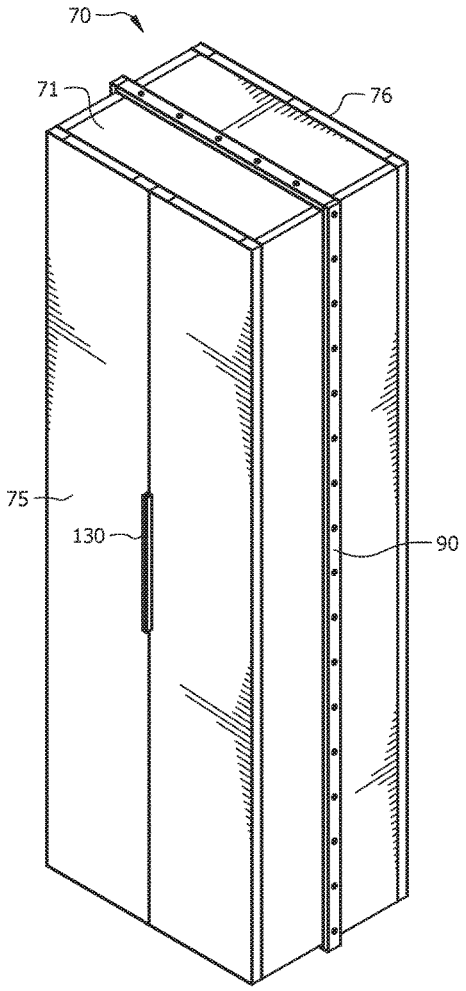
FIG. 15 is a perspective view of storage unit with a solid wall for the back side.

In an embodiment, front side 75 may be comprised of at least one storage unit door hingedly connected to first 73 or second 74 sidewall and capable of opening outwardly. In some embodiments, two storage unit doors comprise front side 75 as shown in FIG. 15. Storage unit door may have at least one door handle 130 attached to exterior surface to assist in opening storage unit door. Handle 130 is spaced away from hinges to allow for opening of storage unit door. Alternatively, storage unit door may have cut-outs for a user's hand to assist in opening storage unit door. In some embodiments, the at least one storage unit door may have hooks or other means affixed to interior surface on which articles can be hung.

In some embodiments, back side 76 may be comprised of a solid wall as shown in FIG. 15. In some embodiments where back side 76 is a solid wall, a plurality of orifices 77 can be positioned linearly on inner surface of back side 76 for insertion of shelf supports 84. In other embodiments, hooks, rods, racks, etc. can be positioned on inner surface of back side 76.

Figure 16:
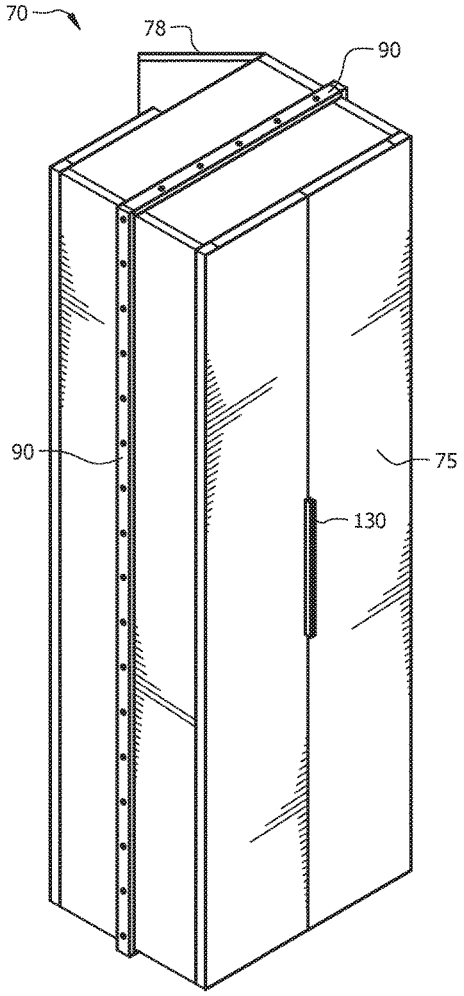
FIG. 16 is a perspective view of storage unit with doors for the back side.

Alternatively, in other embodiments, back side may be comprised of at least one storage unit door 78 hingedly connected to first 73 or second 74 sidewall and capable of opening outwardly. In some embodiments, two storage unit doors 78 comprise back side as shown in FIG. 16. Storage unit door 78 may have at least one door handle attached thereto to assist in opening storage unit door 78 with handle being spaced away from hinges. Alternatively, storage unit door 78 may have cut-outs for a user's hand to assist in opening storage unit door 78. In some embodiments, the at least one storage unit door 78 may have hooks or other means affixed to interior surface on which articles can be hung.

Figure 17:
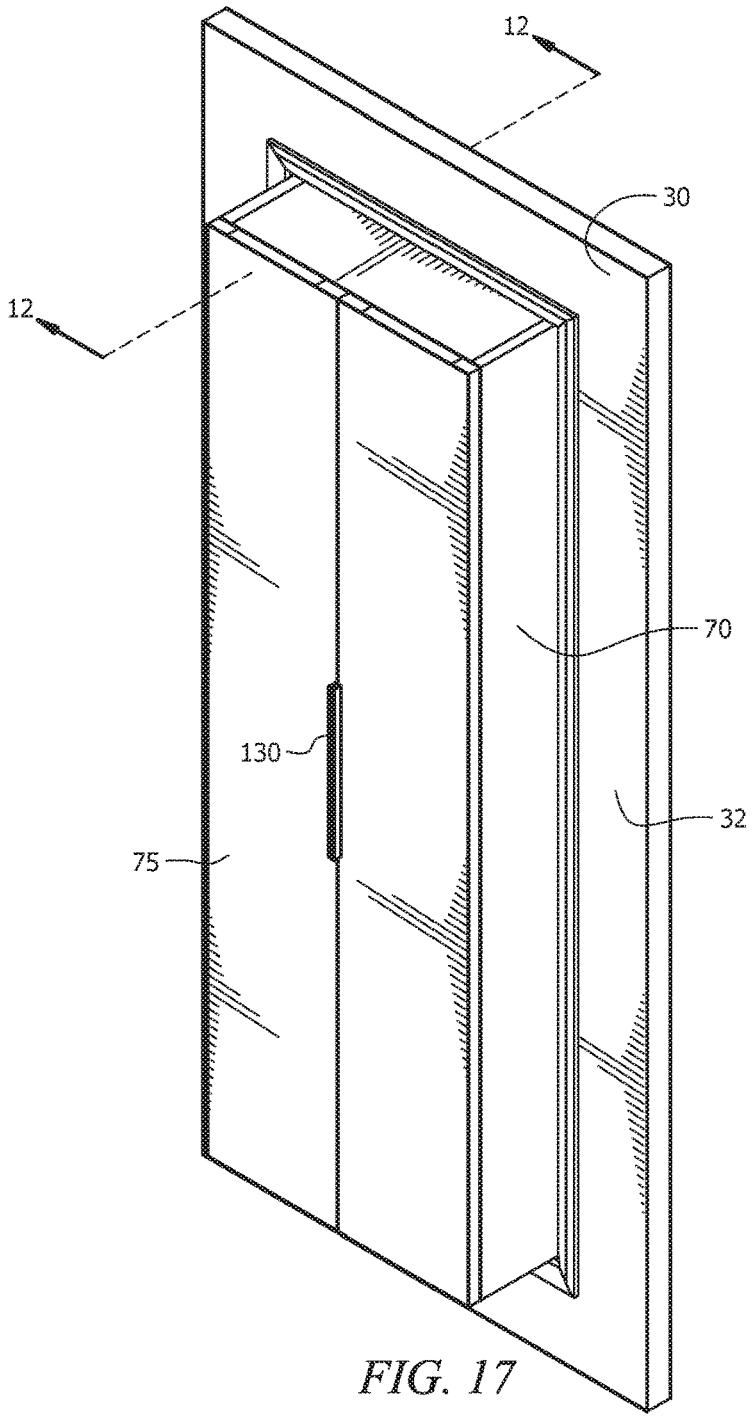
FIG. 17 is a perspective view of the storage unit mounted within the door.

FIG. 17 depicts storage unit 70 positioned within inner perimeter 36 of door 30. As shown in the image, storage unit 70 can extend beyond exterior surface of front side 32 of door 30. Similarly, storage unit 70 can also extend beyond exterior surface of back side 34 of door 30. Extension of storage unit from each side of door 30 can be at any depth as long as door is capable of opening and closing and storage unit 70 is capable of being securely housed within inner perimeter 36 of door 30. Sectional view illustrating attachment of storage unit 70 via track system 40 is shown in FIGS. 18 and 19.

Figure 18:
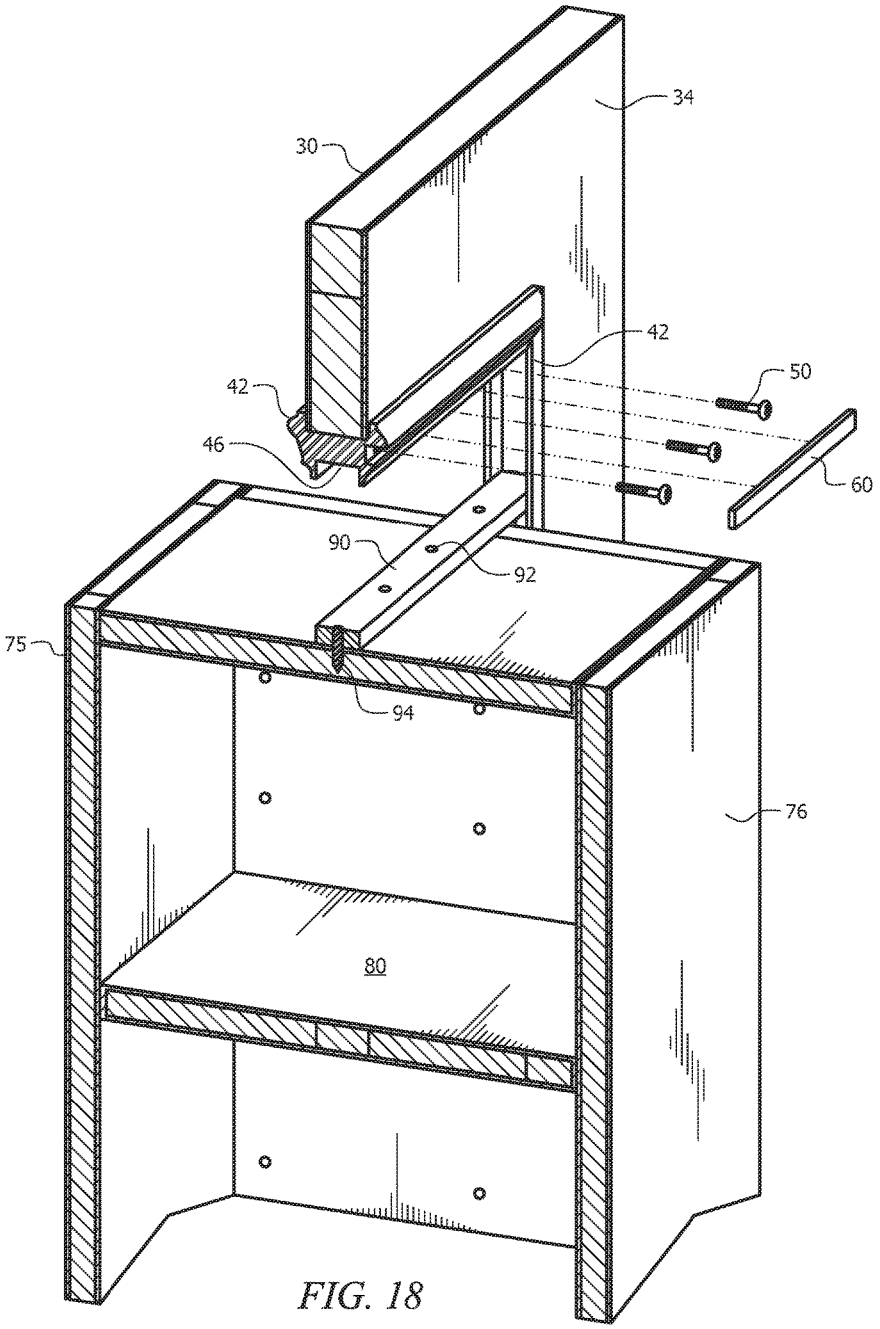
FIG. 18 is a cross sectional view taken along line 12 of FIG. 10 depicting attachment of storage unit to door via track system.
Figure 19:
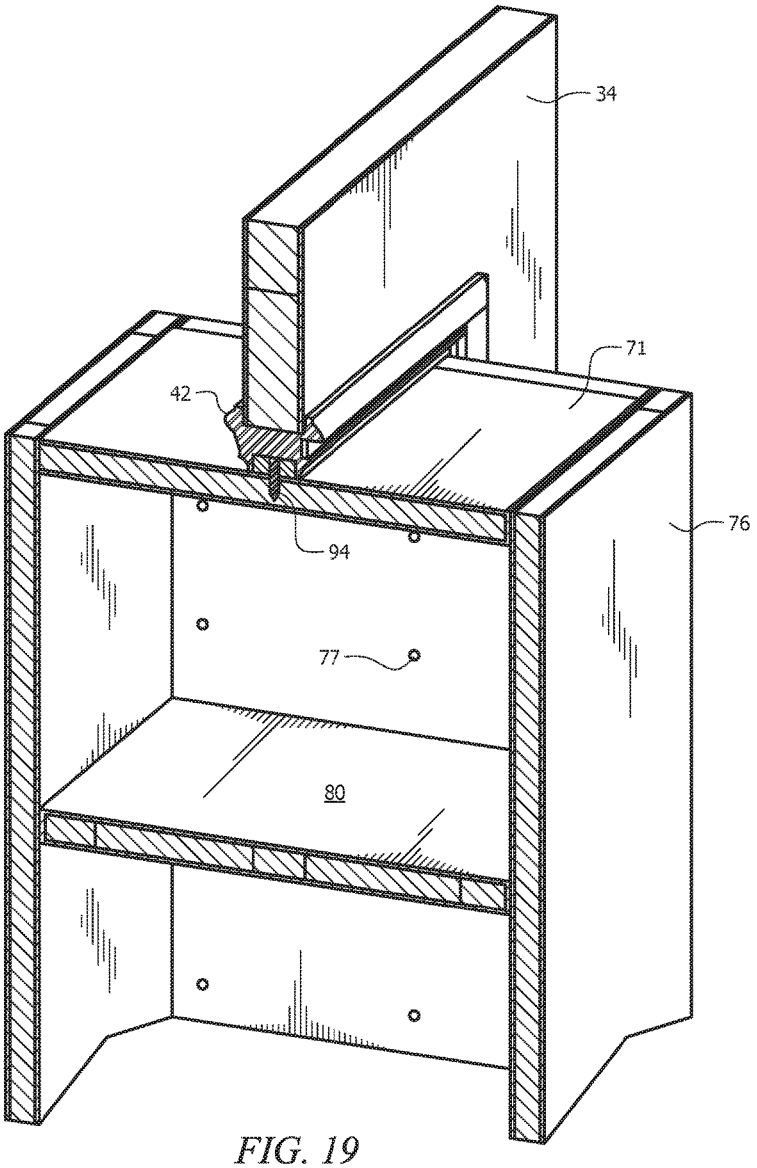
FIG. 19 is a cross sectional view taken along line 12 of FIG. 10 depicting storage unit securely attached to door via track system.

FIGS. 18 and 19 depict an embodiment using one type of track system for attachment of storage unit 70 to inner perimeter 36 of door 30 via track system 40. Inner perimeter 36 of door 30 is depicted as being housed within channel of first u-shaped flange 44. Connection bar 90 is depicted as positioned substantially in the center of exterior surface of top side 71 of storage unit 70. While connection bar 90 is depicted as being positioned in the center of top side 71, connection bar 90 can be positioned at any point along exterior surface of top side 71 given that such position allows for opening and closing of door 30. Connection bar 90 is fixedly attached to exterior side of top side 71 of storage unit 70 by any attachment means 94 known in the art including, but not limited to, screws, nails, adhesive, etc. While attachment of top side 71 of storage unit 70 is depicted, the same attachment occurs along outer perimeter surface of storage unit 70, namely along first 73 and second 74 sidewalls and bottom side 72 of storage unit 70. Attachment means 50 are depicted as being inserted into apertures 52 in back of channel of third u-shaped flange 48. As discussed previously, attachment means 50 can be any of those known in the art as being useful for compressing two sides of an object together including, but not limited to, screws and nails. Inserting connection bar 90 into channel of second u-shaped flange 46 and tightening of attachment means 50 into apertures 52 in back of channel of third u-shaped flange 48 provides compression of sides of channel of second u-shaped flange 46 so that sides of channel tightly compress against connection bar 90 and also provides compression of sides of channel of first u-shaped flange 44 so that sides of channel tightly compress against inner perimeter 36 of door 30 to securely attach storage unit 70 to inner perimeter 36 of door 30 as depicted in FIG. 19. Molding 60 is shown as being inserted into channel of third u-shaped flange 48 after attachment means 50 have been tightened to hide attachment means 50 from view.

Figure 20:
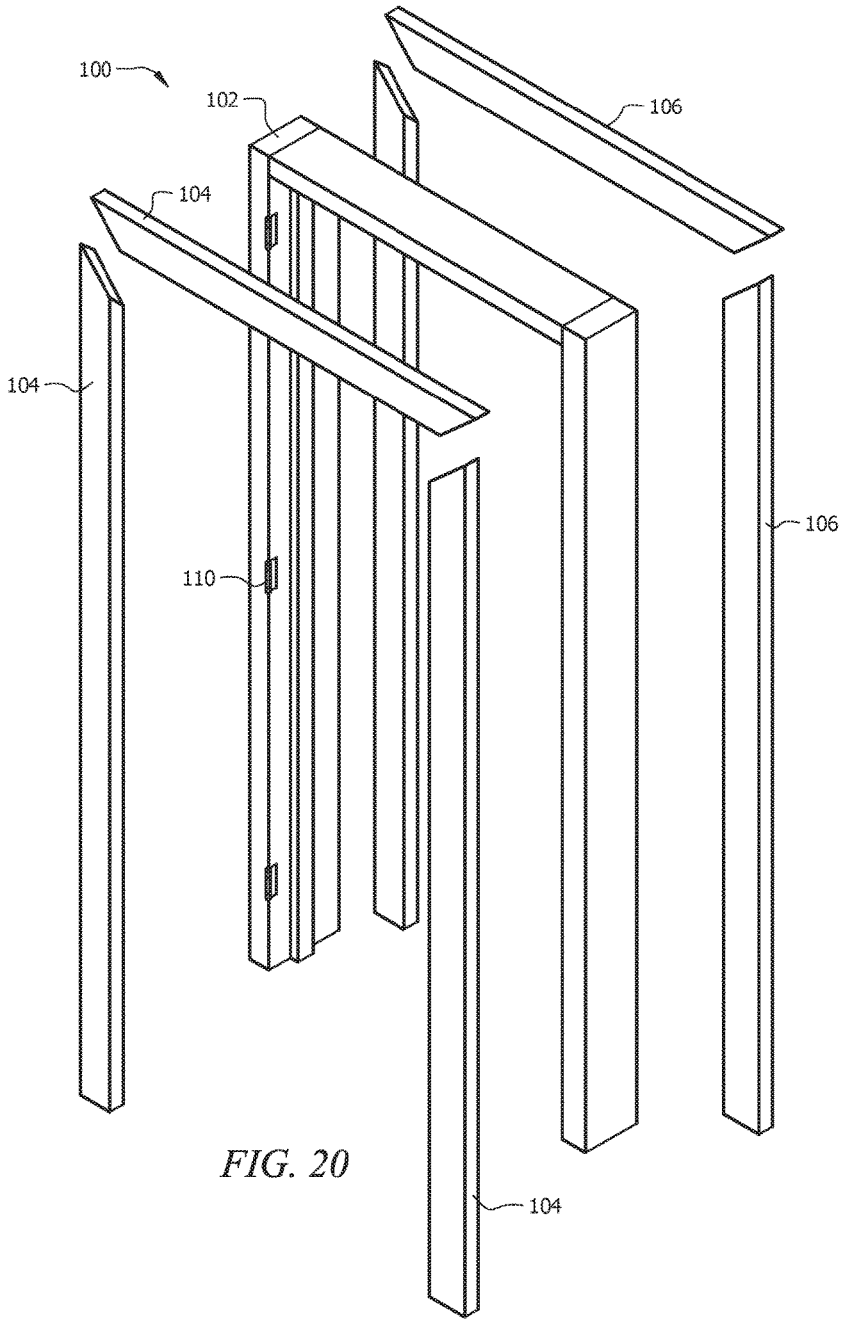
FIG. 20 is an exploded view of door casing.
Figure 21:
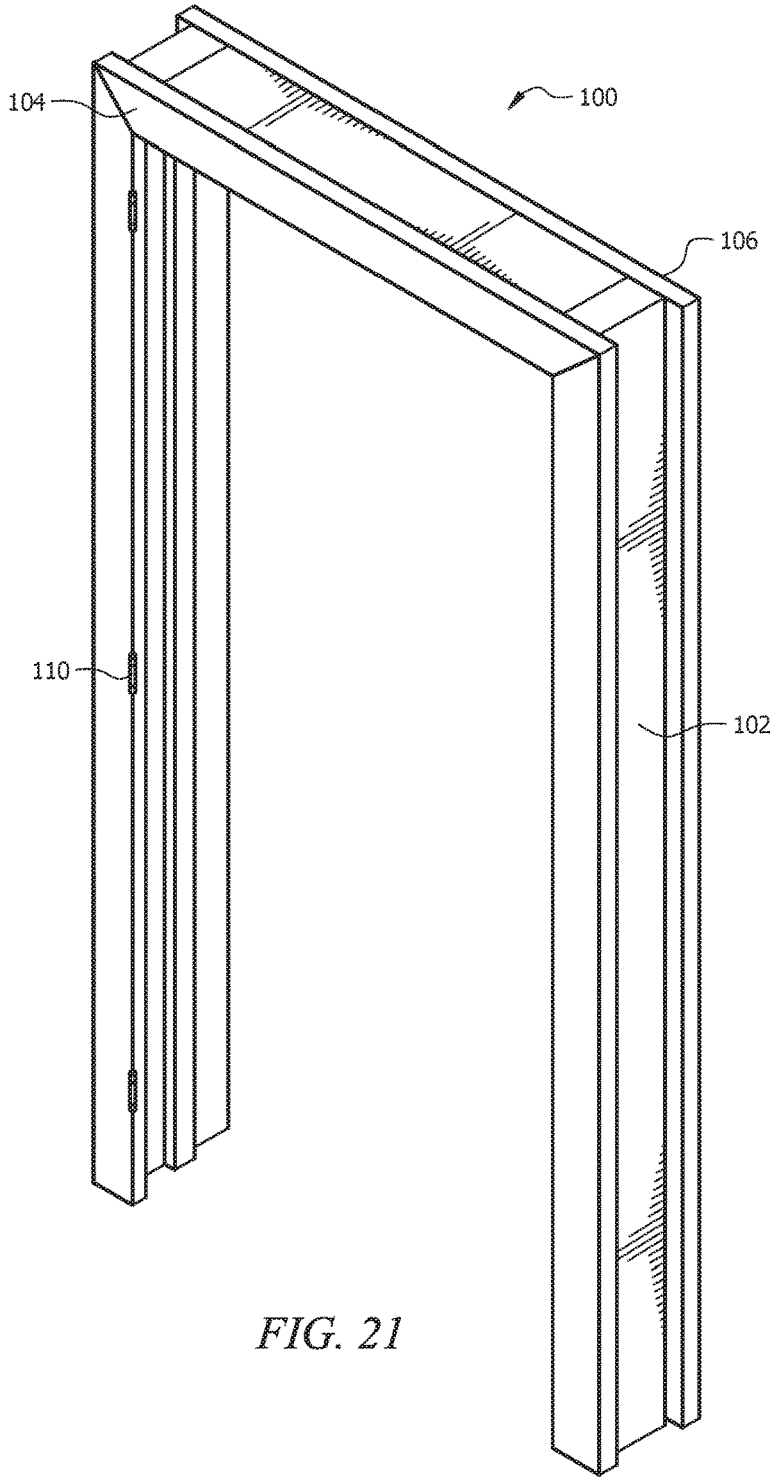
FIG. 21 is a perspective view of door casing.

FIG. 20 depicts door casing 100 which is generally comprised of door frame 102, front molding 104 and back molding 106. Door frame 102 is generally comprised of opposing longitudinal first and second sidewalls in parallel orientation connected by a top side. One of first or second sidewalls may have a plurality of hinges 110 disposed along the longitudinal axis of the sidewall to attach door 30 to door frame 102. Door frame 102 is designed to fit within a cut-out of a wall configured to house a door. Door frame 102 can be attached to the wall by any means known by those in the art including, but not limited to, nails, screws and adhesive. Front molding 104 is attached to front exterior surface of door frame 102, and also to wall, while back molding 106 is attached to back exterior surface of door frame 102, and also to opposing side of wall to create a channel within which cut-out for door in wall is positioned so that door frame 102 lies flush with cut-out for door in wall. FIG. 21 depicts fully assembled door casing 100. In some embodiments, door casing 100 is not needed as an existing door can be removed and replaced with door assembly 20 containing storage unit 70. In this embodiment, the original door frame is used with the novel storage system. In other embodiments, an existing door can be reconfigured to hold storage unit 70 by hollowing out the center of the existing door to create inner perimeter and attaching track system and ultimately storage unit 70 to inner perimeter of door as described previously.

Figure 22:
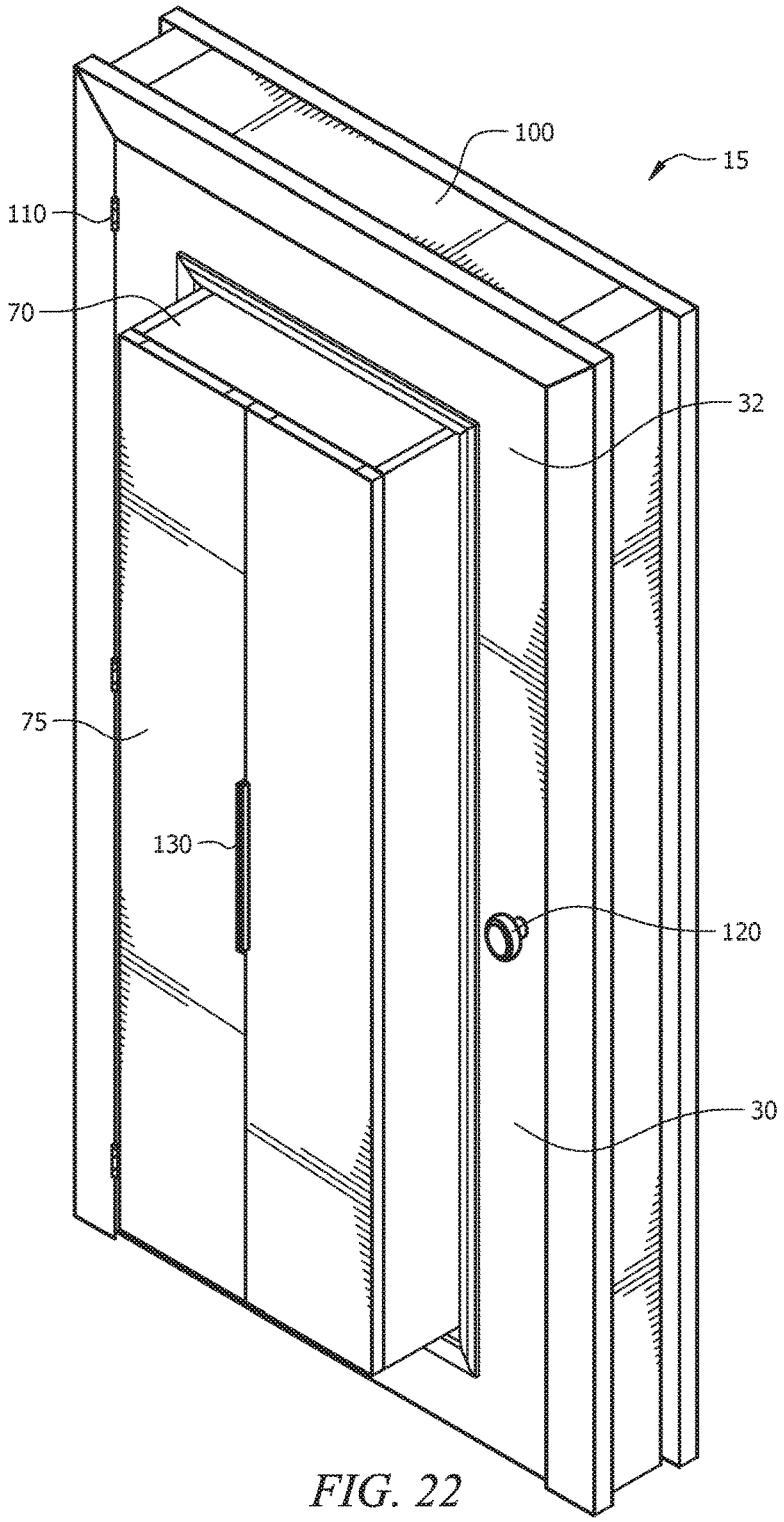
FIG. 22 is a perspective view of storage system with the door closed.
Figure 23:
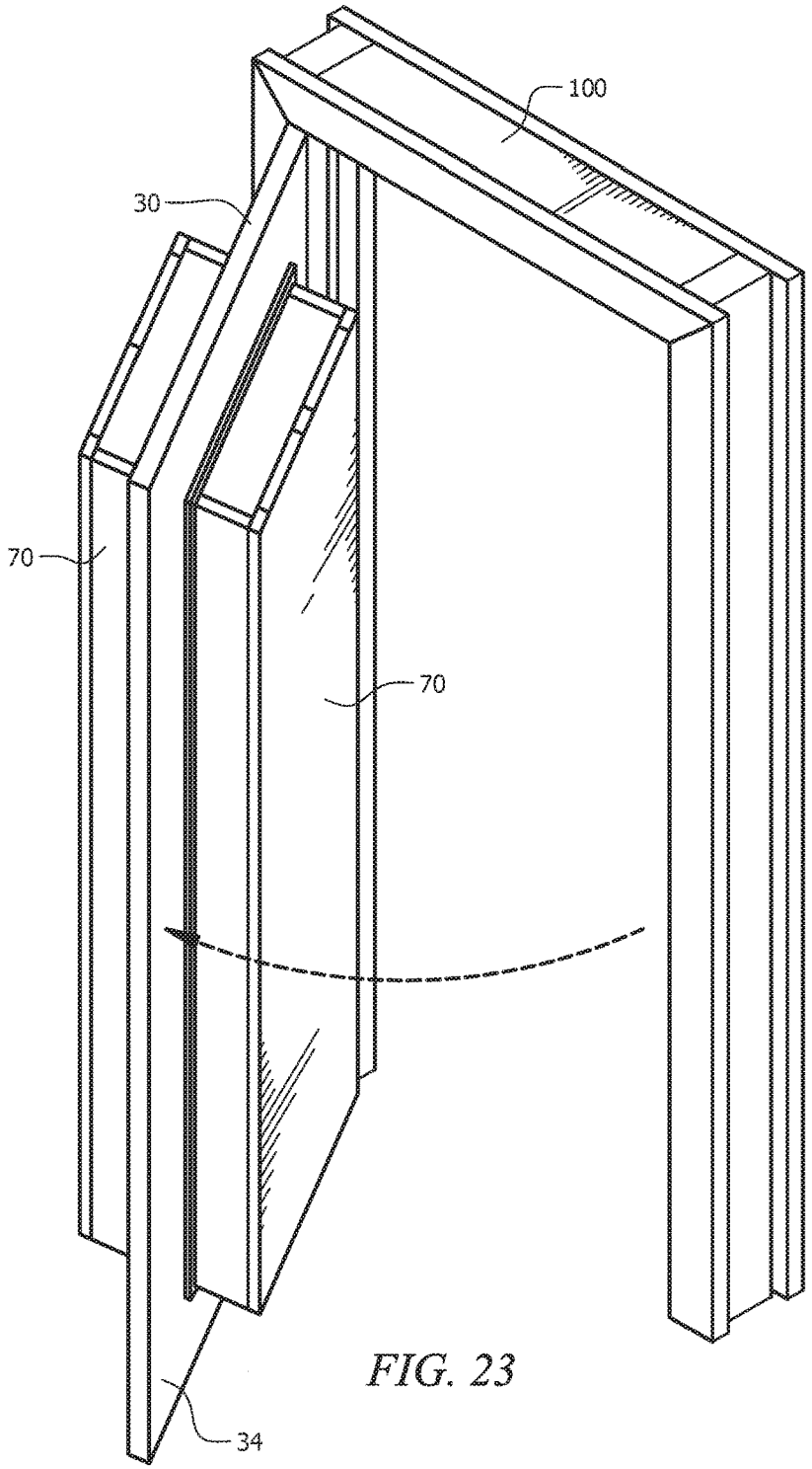
FIG. 23 is a perspective view of storage system with the door opened.

FIGS. 22 and 23 depict fully assembled storage system 10. As shown in the figures, door assembly 20 containing storage unit 70 is attached to door casing 100 via a plurality of hinges 110 located on one side of door 30. Handle 120 is positioned opposite hinges 110 on exterior surface of front side 32 of door 30. Engaging handle 110 to pull door towards the user allows door to pivot along plurality of hinges 110 to open door as shown in FIG. 23.

Door 30 may be manufactured of a variety of materials including, but not limited to wood and metal. In an embodiment, door 30 is comprised of 4 separate frame elements which are interconnected to form door 30. These frame elements are positioned around and attached to the outer perimeter of storage unit 70. The frame elements are connected to each other at the 4 corners and each frame element is connected to outer perimeter of storage unit 70. In an embodiment, inner perimeter of each frame element contains a channel or slot which comprises a second embodiment of a track system. Channel is configured to house a lip or flange positioned on outer perimeter of storage unit 70 to attach storage unit 70 to door 30.

Similarly, storage unit 70 may also be manufactured of a variety of materials including, but not limited to wood, hard plastics including thermoformed plastics, metal, and manufactured wood. In some embodiments, front and/or back sides/doors of storage unit can be manufactured of a wood stile having adhesive onto which a fiberglass skin is adhered. In some embodiments, a layer of foam having adhesive is positioned between fiberglass skin and wood stile.

Track 42 can be manufactured of a material which allows for compression of sides of channels of first 44 and second 46 u-shaped flanges including, but not limited to, semi-flexible metals and plastics.

In some embodiments, exterior surfaces of front and back sides of storage unit may be customizable with various skins being available including, but not limited to, mirrored skins, various printed designs, solid colors, etc. In some embodiments, these skins are permanently adhered to exterior surface of front or back side while in other embodiments, at least one clear sleeve may be attached to exterior surface of front or back side of storage unit to create a cavity having a closed bottom and sides and an open top into which different skins can be inserted to allow for the skins to be changed by the user as often as they wish.

In conclusion, the instant invention overcomes the deficiencies of the prior art and allows for a customizable storage unit housed within a door which creates additional storage space in a dwelling without sacrificing valuable floor and wall space. Customization of the storage unit makes the storage system an attractive alternative to conventional storage units which take up significant floor and/or wall space.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween. Now that the invention has been described,

What is claimed is:

1. A storage system comprising:

a door assembly comprising:

a door comprising:

a plurality of door frame members, each having a channel disposed longitudinally along one side;

wherein each of the plurality of door frame members attaches to another of the plurality of door frame members such that the channels align to define an inner perimeter in the shape of a square or rectangle complementary in size and shape to a storage unit; and a mounting system for attaching a storage unit within the inner perimeter of the door; and the storage unit positioned orthogonally within the door comprising:

two thermoformed hard plastic box-shaped components having identical dimensions with each of the box-shaped components having one open side with an outer flange positioned around an outer perimeter of the open side of each of the box-shaped components wherein the open sides of each of the box-shaped components are attached together at the outer flanges to form an outer shell of the storage unit;

a front side, a back side, a first sidewall, a second sidewall, a top side and a bottom side of the outer shell of the storage unit defining a space forming a cavity therein; and at least one storage means contained within the cavity;

wherein the front side of the storage unit comprising at least one access door to provide access to the cavity of the storage unit.

2. The storage system of claim 1, wherein the mounting system comprises the channels of the plurality of door frame members positioned around the inner perimeter of the door.

3. The storage unit of claim 2, wherein the outer flange of the storage unit is positioned within the channels of the mounting system to attach the storage unit to the inner perimeter of the door.

4. The storage system of claim 1, further comprising:

a door casing wherein the door casing comprising:

a door frame;

a front molding attached to a front side of the door frame; and a back molding attached to a back side of the door frame;

wherein the door casing surrounds an outer perimeter of the door.

5. The storage system of claim 1, wherein the storage means are selected from the group consisting of at least one shelf, at least one hanging rod, at least one hook, at least one rack, at least one drawer or a combination thereof.

6. The storage system of claim 1, further comprising at least one handle positioned on a front side of the at least one access door of the storage unit.

7. A storage system comprising:

a door comprising:

a plurality of door frame members, each having a channel disposed longitudinally along one side;

wherein each of the plurality of door frame members attaches to another of the plurality of door frame members such that the channels align to define an inner perimeter in the shape of a square or rectangle complementary in size and shape to a storage unit; and the storage unit positioned orthogonally within the door comprising:

two thermoformed hard plastic box-shaped components having identical dimensions with each of the box-shaped components having one open side with an outer flange positioned around an outer perimeter of the open side of each of the box-shaped components wherein the open sides of each of the box-shaped components are attached together at the outer flanges to form an outer shell of the storage unit;

a front side, a back side, a first sidewall, a second sidewall, a top side and a bottom side of the outer shell of the storage unit defining a space forming a cavity therein;

wherein the outer flanges are is inserted into the channels of the door frame members to mount the storage unit within the door;

at least one storage means contained within the cavity; and at least one access door on the front side of the storage unit to provide access to the cavity of the storage unit.

8. The storage system of claim 7, wherein the storage means are selected from the group consisting of at least one shelf, at least one hanging rod, at least one hook, at least one rack, at least one drawer or a combination thereof.

9. The storage system of claim 7, further comprising at least one handle positioned on a front side of the at least one access door of the storage unit.

10. A storage system comprising:

a door assembly comprising:

a door comprising a plurality of door frame members attached together by a tab and slot system and having a hollow center which defines an inner perimeter; and a mounting system for attaching a storage unit within the inner perimeter of the door wherein the mounting system is a channel; and the storage unit formed from thermoformed plastic positioned orthogonally within the door comprising:

two thermoformed hard plastic box-shaped components having identical dimensions with each of the box-shaped components having one open side with an outer flange positioned around an outer perimeter of the open side of each of the box-shaped components wherein the open sides of each of the box-shaped components are attached together at the outer flanges to form an outer shell of the storage unit;

a front side, a back side, a first sidewall, a second sidewall, a top side and a bottom side of the outer shell of the storage unit defining a space forming a cavity therein; and at least one storage means contained within the cavity;

wherein the front side of the storage unit comprising at least one access door to provide access to the cavity of the storage unit;

wherein a handle is positioned on a front side of the at least one access door;

wherein the door is hingedly connected to a door frame.

11. The storage system of claim 10, wherein the channel of the mounting system is disposed longitudinally along one side of each of the plurality of door frame members.

12. The storage system of claim 11, wherein each of the plurality of door frame members attaches to another of the plurality of door frame members such that the channels align to define an inner perimeter in the shape of a square or rectangle complementary in size and shape to the storage unit.

13. The storage system of claim 10, wherein the outer flange of the storage unit is inserted into the channel of the plurality of door frame members to mount the storage unit within the door.

* * * * *